US007753467B2

(12) United States Patent
Misumi

(10) Patent No.: US 7,753,467 B2
(45) Date of Patent: Jul. 13, 2010

(54) INK JET PRINTING APPARATUS AND INK JET PRINTING METHOD

(75) Inventor: Yoshinori Misumi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 291 days.

(21) Appl. No.: 11/864,528

(22) Filed: Sep. 28, 2007

(65) Prior Publication Data

US 2008/0084442 A1 Apr. 10, 2008

(30) Foreign Application Priority Data

Oct. 6, 2006 (JP) ..... 2006-275305

(51) Int. Cl.
*B41J 2/07* (2006.01)

(52) U.S. Cl. ..... 347/14; 347/10

(58) Field of Classification Search ..... 347/5, 347/9–14

See application file for complete search history.

(56) References Cited

U.S. PATENT DOCUMENTS 5,993,527 A * 11/1999 Tochihara et al. ..... 106/31.85
6,022,092 A 2/2000 Misumi
6,505,903 B2 1/2003 Ishinaga et al.
6,607,261 B1 * 8/2003 Shimada ..... 347/19
6,857,717 B2 2/2005 Misumi
6,874,881 B2 4/2005 Suzuki et al.
7,029,109 B2 4/2006 Shirota et al.
7,055,943 B2 6/2006 Suzuki et al.
2006/0221143 A1 * 10/2006 Kodama ..... 347/70

FOREIGN PATENT DOCUMENTS

JP 2003-176431 6/2003

* cited by examiner

*Primary Examiner*—Huan H Tran
(74) *Attorney, Agent, or Firm*—Fitzpatrick, Cella, Harper & Scinto

(57) ABSTRACT

In an ink jet printing apparatus that ejects a plurality of kinds of pigment inks in small droplets, the drive pulse waveform to be applied to each of the heaters is adjusted according to the viscosity of the ink in a way that assures that the lengths of liquid columns ejected are approximately equal among different colors. This enables the dot areas formed on a print medium to be constant among different colors, realizing an image output with excellent color reproducibility, free from variations in image density and tonality.

1 Claim, 16 Drawing Sheets

| INK COLOR | DRIVE PULSE WAVEFORM | PULSE WIDTH |
|---|---|---|
| CYAN<br>MAGENTA<br>YELLOW |  | 0.30_0.26_0.52μm |
| BLACK |  | 0.30_0.35_0.52μm |
| LIGHT CYAN<br>LIGHT MAGENTA |  | 0.30_0.40_0.52μm |

3.

INK JET PRINTING APPARATUS AND INK JET PRINTING METHOD

BACKGROUND OF THE INVENTION

1. Field of the Invention

The present invention relates to an ink jet printing apparatus and an ink jet printing method that form an image on a print medium by ejecting ink droplets (hereinafter referred to as ink) onto the print medium from a print head.

2. Description of the Related Art

The ink jet printing method has many advantages, such as low noise, low running cost and a relative ease with which the apparatus can be reduced in size and upgraded to have a color printing capability. As digital input devices have achieved technical advances and come into wide use in recent years, there are growing calls in an ink jet printing apparatus market for a high-definition, photo-quality image output. To cope with this demand, efforts are being made to reduce the volume of ink droplets ejected from the print head in the ink jet printing apparatus of recent years.

To realize a high image preservation required for a photograph quality, ink jet printing apparatus that use pigment ink are growing in number year by year. Pigments have higher color saturation than dyes, are not easily affected by ozone and ultraviolet rays and also have higher water-fastness. Stable pigments, both physically and chemically, are highly valuable for use in the ink jet printing apparatus. However, since pigments are not as easily soluble as dyes, appropriate dispersion processing or technique is required for uniformly dispersing pigment particles in a solvent and keeping them in the dispersed state.

For stable dispersion of pigment particles in ink, it is generally practiced to add surfactant or polymer dispersant in ink. These additives comprise a hydrophobic part that adsorbs on the surface of pigment particles and a hydrophilic part that spreads into water producing a three-dimensional and electrostatic dispersion stability. They provide a variety of functions depending on their kind and combination. Thus, by optimally controlling the composition of additives, it is possible to realize ink that has a stable dispersion state and assures high reliability of printing operation.

Optimal composition and amount of additives added to ink vary according to the ink color, i.e., the kind and density of pigment used. Thus, in the color ink jet printing apparatus using a plurality of color pigment inks, the physical property often differs from one ink to another.

Focusing on the fact that such physical property variations lead to instability of operations, such as suction-based recovery operation in the apparatus, Japanese Patent Laid-Open No. 2003-176431 discloses a technique for keeping the physical properties of a plurality of inks composed of different pigments within a predetermined range.

However, as the ink droplets are being progressively reduced in size in recent years, some instances have been recognized in which differences in physical property among different color inks have come to affect the ink ejection operation and even the image quality.

FIG. 1 shows how ink ejections are affected by physical property differences. In the figure, a printing element board 24 on a print head 1 has a plurality of nozzle columns arranged in a main scan direction, each adapted to eject a different ink. Here is shown a state in which different inks are being ejected from different nozzle columns when the nozzle columns are driven under the same condition.

Generally, an ink droplet ejected from a nozzle separates into a main drop 101 that constitutes a major part of the ejected volume, and a small satellite 102. At this time, if the ejection drive conditions are the same, a flying speed of the main drop 101 is almost constant even among different ink colors. Studies conducted by the inventor of this invention, however, have found that the speed of the satellite 102, which has a small mass, varies depending on the physical property of the ink, particularly a viscosity. In FIG. 1, a speed difference among different satellites 102 is shown to have translated into a difference among the inks in a distance between the main drop 101 and its satellite 102.

In a serial type ink jet printing apparatus that forms an image by reciprocally scanning a carriage mounting the print head over the print medium, the distance between the main drop and its satellite translates into a deviation of the landing position on the print medium in the main scan direction. So, when, as shown in FIG. 1, the distance between the main drop 101 and its satellite 102 differs among different colors, the amount of landing position deviation varies among different colors. The landing position deviation between the main drop and satellite deforms the shape of a dot formed on the print medium, enlarging its area. Therefore, the greater the distance between the main drop and its satellite, i.e., the slower the flying speed of the satellite, the larger the area of the dot formed on the print medium will be. As a result, in an ink jet printing apparatus that forms a color image using a plurality of inks with different physical properties, the dot landing deviations cause image density variations and color deviations, degrading the printed image. Particularly in a high-speed print mode that moves the carriage at high speed while ejecting ink, the distance between the main drop and its satellite increases, making the density difference among ink colors more conspicuous.

A study conducted by the inventor of this invention has found that speed variations among satellites are caused mainly by differences in ink viscosity. Our comprehensive experiments have observed that, under the condition of the same ejection speeds and the same ejection volumes (of main drops), the length of a liquid column while flying (the distance from the main drop to the satellite) increases as the viscosity increases and that the number of satellites tends to decrease as the surface tension increases.

As described above, in an ink jet printing apparatus of recent years that forms an image by using small drops of color inks, differences in physical property among inks translate into differences in the ejection characteristic, which in turn degrades an image quality. Such an image problem caused by the ejection speed difference between the main drop and its satellite has newly been brought to the fore by the rapid size reduction of ink droplets in recent years. This is because as the main drop becomes smaller, the presence of the satellite becomes more significant, making the printing position deviations of these drops more likely to affect the image being printed. Japanese Patent Laid-Open No. 2003-176431 does not refer at all to the image deterioration problem mentioned above, though it pays attention to the fact that differences in physical property among different ink colors affect a suction operation. So, even in a case where a plurality of inks used have physical properties that fall within the range of conditions disclosed in Japanese Patent Laid-Open No. 2003-176431, the difference in the flying speed among the satellites still results. It therefore has not been possible to prevent degradations in image quality that the present invention aims to solve.

SUMMARY OF THE INVENTION

The present invention has been accomplished to solve the problem described above. In an ink jet printing apparatus that ejects a plurality of kinds of pigment inks in small droplets, it is therefore an object of this invention to adjust drive conditions of a print head to make the ejection state constant among different colors in order to ensure an output of a high quality image with uniform, stable density and tonality among different colors.

The first aspect of the present invention is an ink jet printing apparatus for forming an image by using a print head, wherein the print head has a plurality of printing elements for a plurality of inks with different viscosities, wherein the printing elements eject ink when applied a voltage pulse, the ink jet printing apparatus comprising: a drive adjust means to adjust a waveform of the voltage pulse, for each of the plurality of inks, in a way that reduces an ejection speed of ink as the viscosity of ink increases.

The second aspect of the present invention is an ink jet printing method for forming an image by using a print head, wherein the print head has a plurality of printing elements for a plurality of inks with different viscosities, wherein the printing elements eject ink when applied a voltage pulse, the ink jet printing method comprising the step of: adjusting a waveform of the voltage pulse, for each of the plurality of inks, in a way that reduces an ejection speed of ink as the viscosity of ink increases.

Further features of the present invention will become apparent from the following description of exemplary embodiments (with reference to the attached drawings).

DESCRIPTION OF THE EMBODIMENTS

First Embodiment

Figure 2:
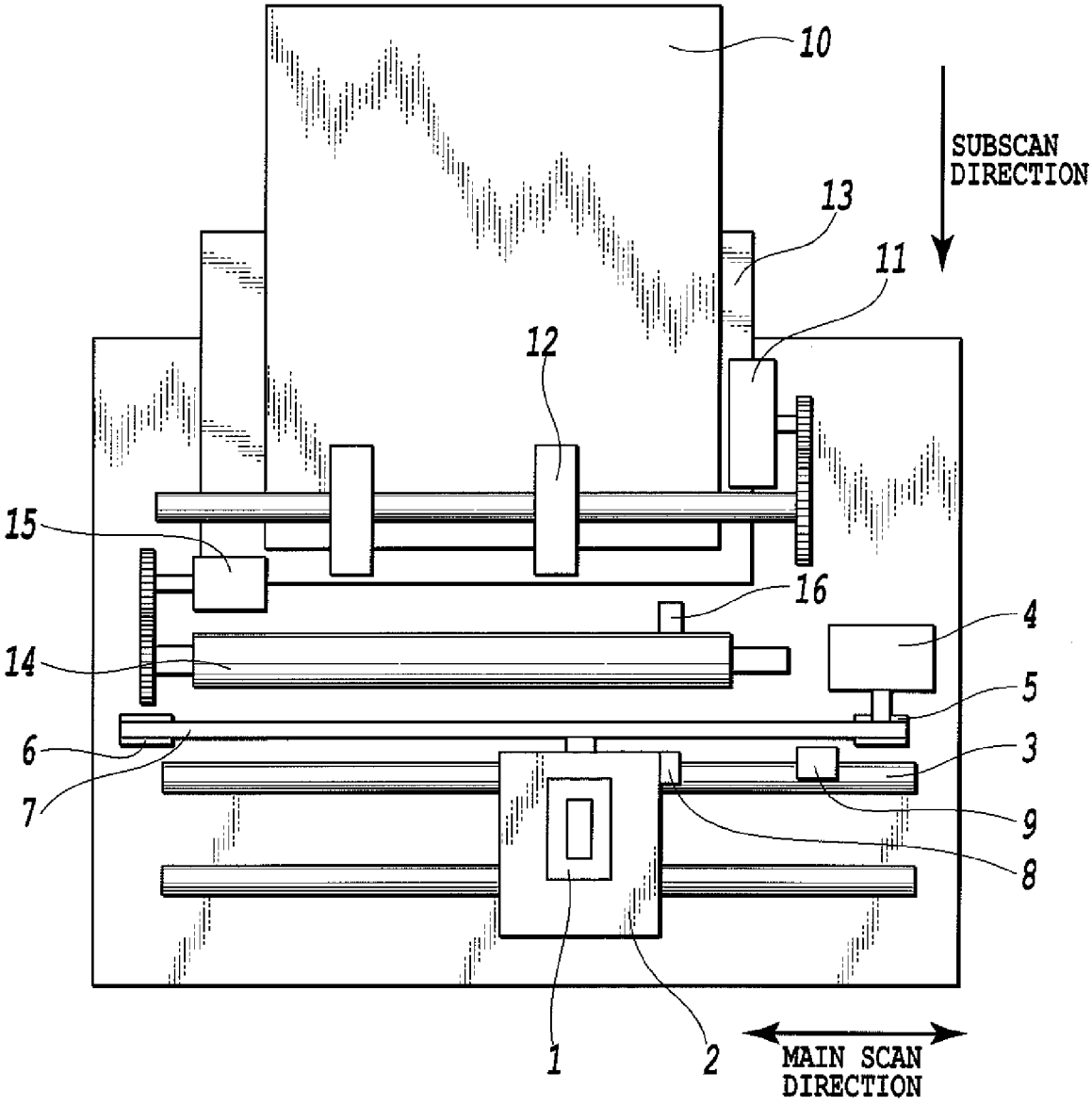
FIG. 2 shows a construction of a main part of a serial type ink jet printing apparatus applied in embodiments of this invention.

FIG. 2 shows the construction of an essential part of a serial type ink jet printing apparatus applied in this embodiment. A drive force of a carriage motor 4 is transmitted through a motor pulley 5, a follower pulley 6 and a timing belt 7 to a carriage 2, which, with the print head cartridge 1 mounted on it, executes reciprocal scans in the main scan direction, guided and supported by a guide shaft 3 extending in the main scan direction. The carriage 2 has a home position sensor 8 at one end thereof which, when it moves past the position of a shield plate 9, detects that the carriage 2 is at the home position. Though not shown, in an area where a printing operation is performed by the print head cartridge 1 mounted on the carriage 2 there is arranged a platen that supports a print medium from below. The print medium on the platen is thus horizontally flat so that a distance between a nozzle face of the print head and the print medium is kept constant.

Sheets of print medium 10 stacked on an auto sheet feeder (ASF) 13, such as print paper and plastic thin plates, are separated and fed one at a time as a feed motor 11 rotates pickup rollers 12. Then, as the printing operation proceeds, the print medium is intermittently transported in a subscan direction by a transport roller 14. The rotating force of the transport roller 14 is supplied from an LF motor 15 through gears not shown.

A paper end sensor 16 detects when a front or rear end of the print medium has passed it. This detection timing may be used to control a print start position during paper feeding or determine a distance from the current printing position to the rear end of the print medium.

The print head cartridge 1 is replaceably positioned on the carriage 2 by a positioning means. The carriage 2 and the print head cartridge 1 are each provided with a connector for signal transfer, so when the print head cartridge 1 is mounted on the carriage 2, they are connected through the connectors.

Figure 3:
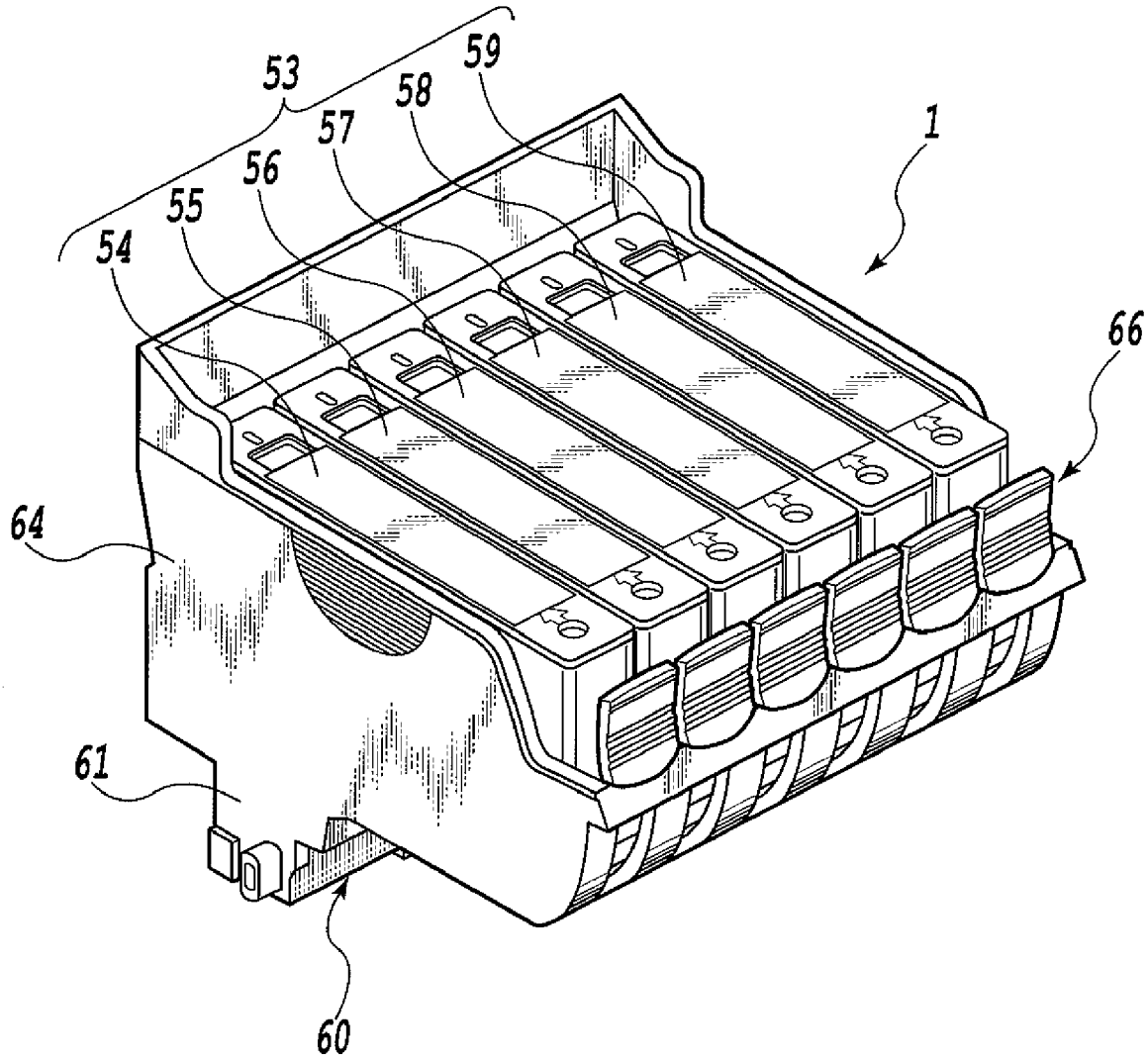
FIG. 3 is a perspective view showing a print head cartridge applied in the embodiments of this invention.

FIG. 3 is a perspective view showing the print head cartridge 1 applied in this embodiment. The print head cartridge 1 of this embodiment mainly comprises a printing element unit 60 having printing elements for ink ejection, an ink supply unit 61 to supply ink to the printing element unit 60, and a tank holder 64 that allows a plurality of ink tanks to be replaced individually. Denoted 54 to 59 are ink tanks of six colors, with tank 54 containing cyan ink, 55 magenta ink, 56 yellow ink, 57 black ink, 58 light cyan ink and 59 light magenta ink. Since the individual color ink tanks can be replaced according to their ink consumption, an efficient use of inks is assured, keeping the running cost low. For simplicity, six color ink tanks 54-59 may in some cases be referred to simply as an ink tank 53.

Figure 4:
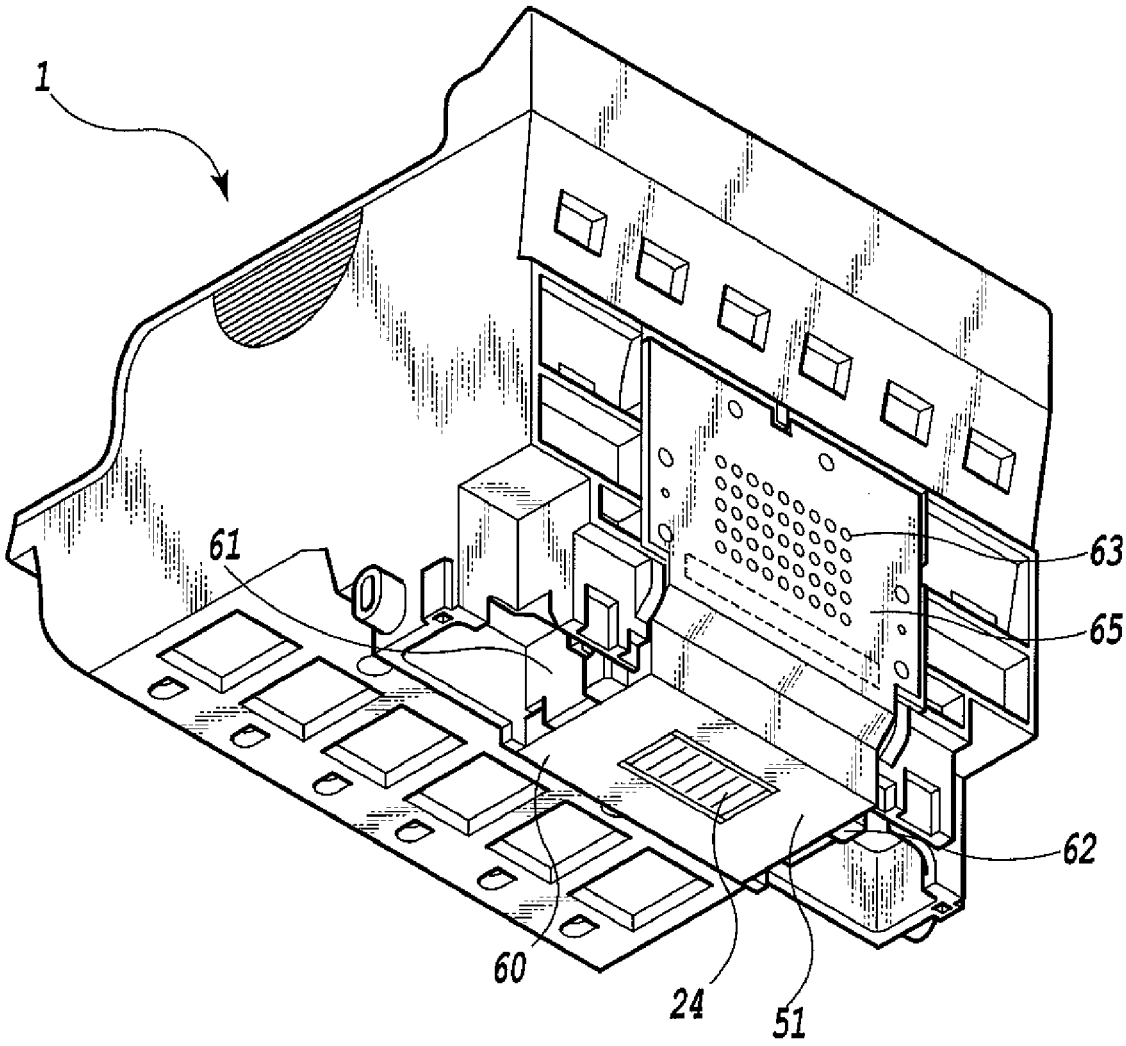
FIG. 4 is a perspective view of the print head cartridge 1 as seen from a printing element unit 60 side.

FIG. 4 is a perspective view of the print head cartridge 1 as seen from the printing element unit 60 side. The printing element unit 60 comprises mainly a printing element board 24, a plate 62, an electric wiring tape 65 and an electric contact board 63.

Figure 5:
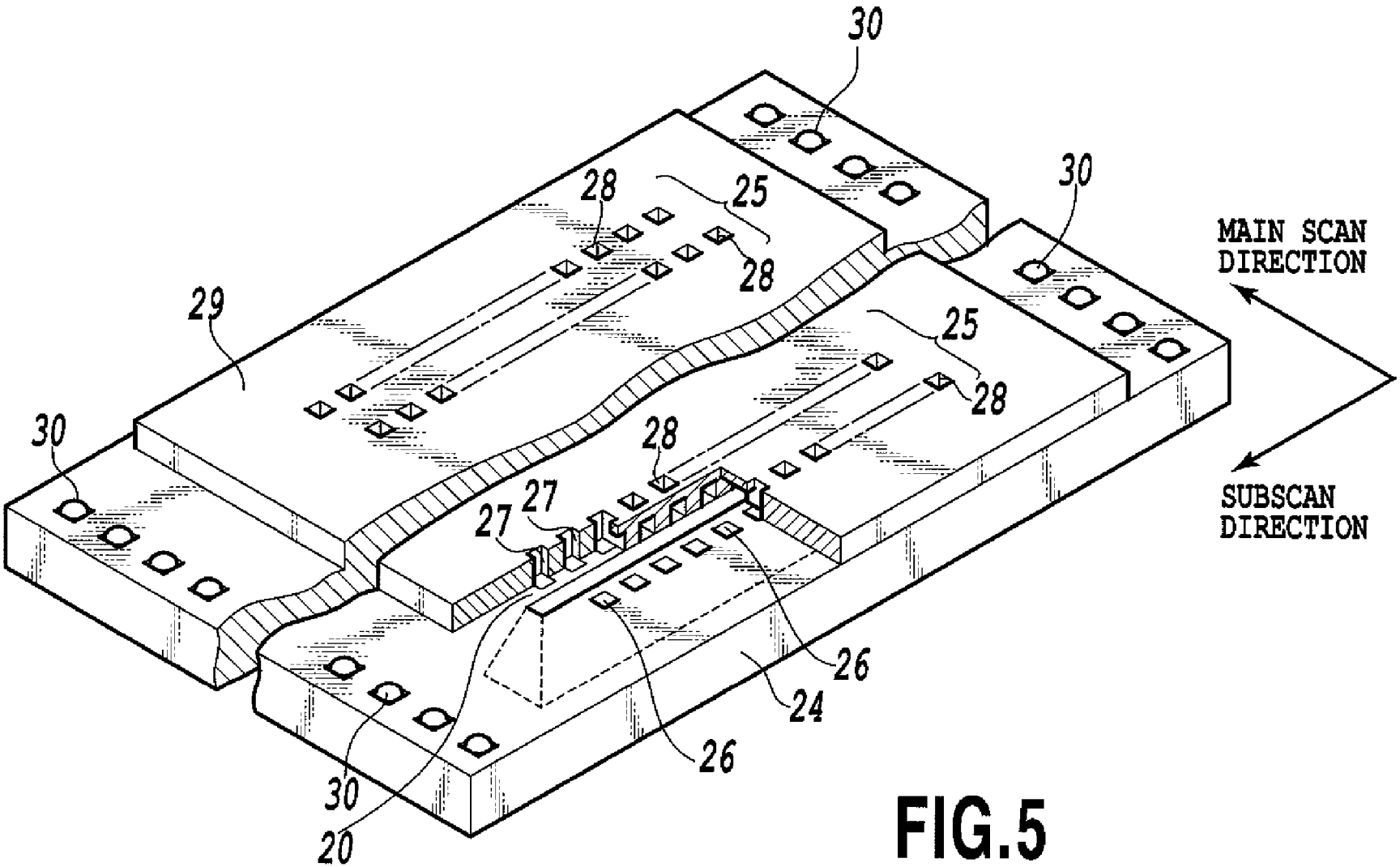
FIG. 5 is a partly cutaway, perspective view showing a construction of an ejection portion formed on a printing element board 24.

FIG. 5 is a partly cutaway perspective view showing the construction of an ejection portion formed on the printing element board 24. The board 24 is formed of a silicon wafer 0.5-1 mm thick, constitutes a part of an ink path member and functions also as a support for a material layer in which heaters, ink paths and ejection openings are formed. Other than silicon, the board 24 can also be made of glass, ceramics, plastics or metals.

On the board 24, heaters (electrothermal conversion elements) 26, a means for generating thermal energy, are arrayed at a 600-dpi pitch in the subscan direction on each side of the longitudinal length of the ink supply channel 20. These two columns of heaters are staggered half-pitch in the subscan direction from each other. The board 24 is also formed with electric wiring of, e.g., aluminum to supply electricity to individual heaters 26 from electrodes 30. These heaters 26 and the electric wiring are formed by a deposition technique. On the electrodes are formed bumps of gold.

Formed on the board 24 by photolithography is a cover resin layer 29 that leads ink to the individual heaters. The cover resin layer 29 has formed therein flow paths 27 at positions corresponding to the associated heaters and the common ink supply channel 20 that supplies ink to the individual flow paths 27. A front end of each flow path 27 constitutes an ejection opening 28 from which an ink droplet is ejected as a result of film boiling by the heater 26. In the above construction, ink supplied from the same ink supply channel 20 can be ejected in the form of ink droplets for printing at a resolution of 1,200 dpi in the subscan direction by energizing the individual heaters at predetermined timings.

An ink supply channel 20 supplies one kind of ink. A plurality of such ink supply channels 20 may be arranged in parallel on the same board 24 so that different kinds of inks can be ejected.

Figure 6:
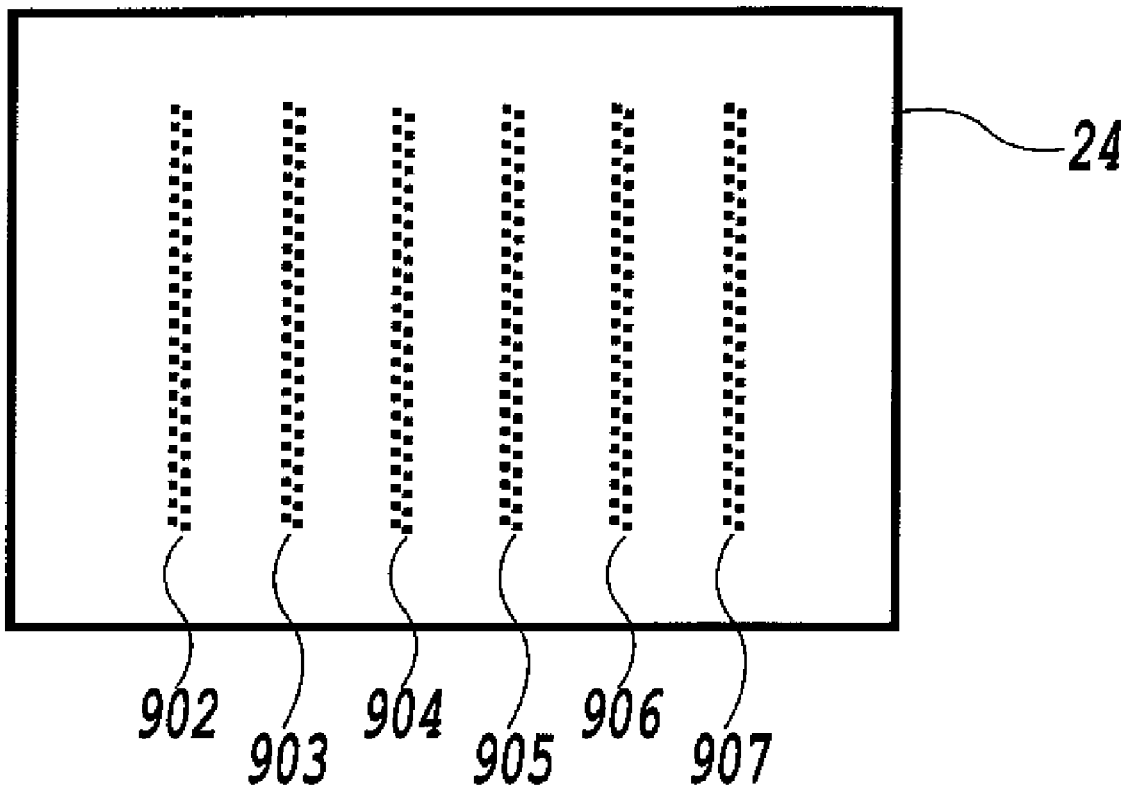
FIG. 6 is a schematic view showing the printing element board 24 used in the embodiments of this invention, as seen from the side of ejection openings.

FIG. 6 is a schematic view of the printing element board 24 of this embodiment as seen from the ejection opening (or nozzle) side. The six color nozzle columns are arranged side by side, as shown in the figure, in the order of, from left to right, cyan 902, magenta 903, yellow 904, black 905, light cyan 906 and light magenta 907.

Figure 7:
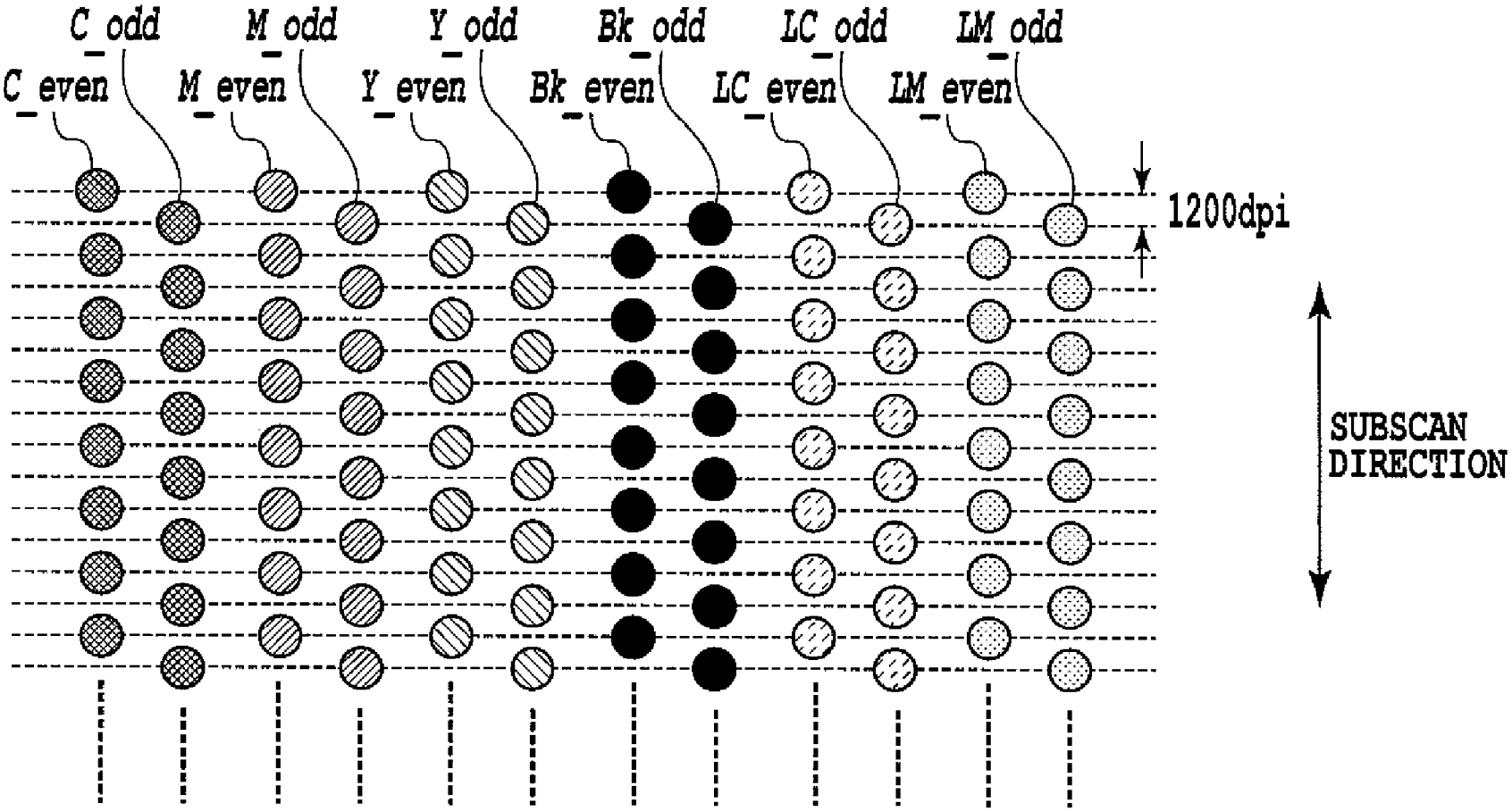
FIG. 7 is an enlarged view of columns of ejection openings of individual colors.

FIG. 7 is an enlarged view of the individual color nozzle columns. As already shown in FIG. 5, each color nozzle column is composed of two nozzle columns (even and odd) and can print dots at a resolution of 1,200 dpi in the subscan direction.

To eject ink, a predetermined voltage pulse is applied to the heaters 26 corresponding to the individual ejection openings 28. When energized, each of the heaters quickly generates heat, causing film boiling in the ink in contact with the heater. As a bubble produced by the film boiling grows, ink is ejected from the ejection opening in the form of a droplet.

Figure 8:
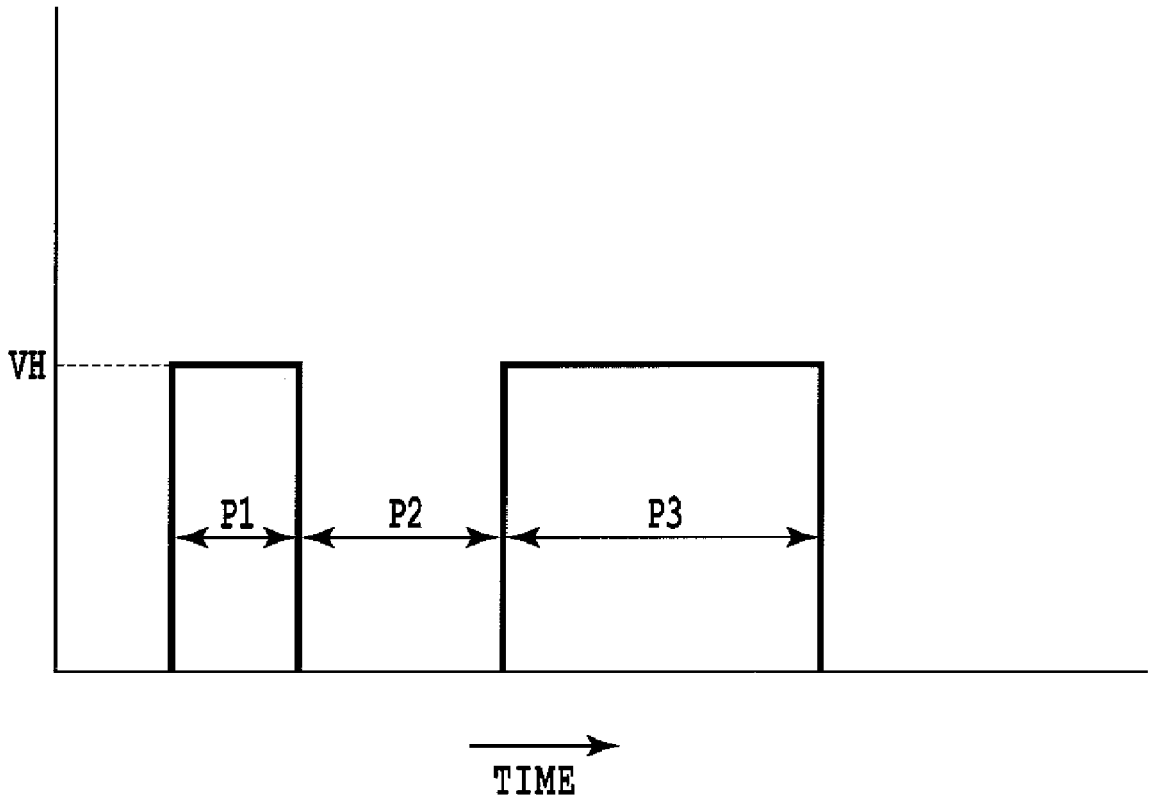
FIG. 8 is a timing chart showing voltage pulses to be applied to individual heaters to execute one ejection operation.

FIG. 8 is a timing chart showing how voltage pulses are applied to individual heaters to execute one ejection operation. An abscissa represents time and an ordinate represents a voltage value VH to be applied to the heater. In the figure, P1 denotes a duration of application of a preheat pulse, P3 denotes a duration of a main heat pulse, and P2 denotes an interval between the preheat pulse and the main heat pulse.

The preheat pulse is a pulse used to warm ink around the heater surface and its application duration P1 is determined so as to keep the generated energy within a level that will not result in the formation of a bubble. The main heat pulse on the other hand is a pulse used to cause ink warmed by the preheat pulse to trigger the film boiling to execute an ejection, and its application duration P3 is set longer than P1 to produce enough energy to create a bubble.

Now, let us turn to FIG. 4 again. The plate 62 is formed of an alumina ($Al_2O_3$) material 0.5-10 mm thick and supports the printing element board 24 from the back. The material of the plate 62 is not limited to alumina. Other materials with a linear expansion coefficient equivalent to that of the material of the printing element board and with a heat conductivity equivalent to or higher than that of the printing element board may be used.

The electric contact board 63 connects to the connector of the carriage 2 to receive signals, such as print signals, delivered from the printed circuit board of the printing apparatus body. The received signals are transferred through the electric wiring tape 65 to the printing element board 24. The electric contact board 63 is positioned and fixed at the back of the ink supply unit 61, as shown. The positioning of the electric contact board 63 is done by inserting two terminal positioning pins protruding from the back of the ink supply unit 61 into terminal positioning holes of the board.

The ink supply unit 61 comprises an ink supply member, a flow path forming member, a joint seal member, a filter and a seal rubber. Here, the ink supply member will be briefly explained.

The ink supply member is molded from resin with an improved shape stiffness achieved by mixing 5-40% glass filler. It introduces ink from the ink tank 53 into the printing element unit 60 and also constitutes a part of a means for holding the removable ink tank 53. The ink supply member, along with the tank holder 64, forms an accommodation portion in which to removably accommodate the ink tank 53. At a bottom of the accommodation portion there are provided tank positioning holes that engageably receive tank positioning pins of the ink tank 53. A rear wall of the accommodation portion is formed with holes that engage claws of the ink tank. At a front of the ink tank 53 is provided a movable lever 66 formed with a claw that engages the wall of the accommodation portion. The ink tank 53 can be removed by elastically deforming the lever with a force.

The printing element unit 60 and the ink supply unit 61 are joined together by screws, with a joint seal member sandwiched between the ink supply channels in the plate 62 and the ink introducing ports in the flow path forming member, the joint seal member having holes therein at the positions of these openings. The joint seal member is formed of an elastic material with a small permanent compressive strain. With the joint seal sandwiched under pressure between the printing element unit 60 and the ink supply unit 61, ink leakage between the ink supply channels and the ink introducing ports can be prevented, assuring a normal supply of ink.

By joining the ink supply unit 61 and the printing element unit 60 and further by joining the ink supply unit 61 and the tank holder 64 as described above, the assembly of the print head cartridge 1 is complete.

Figure 9:
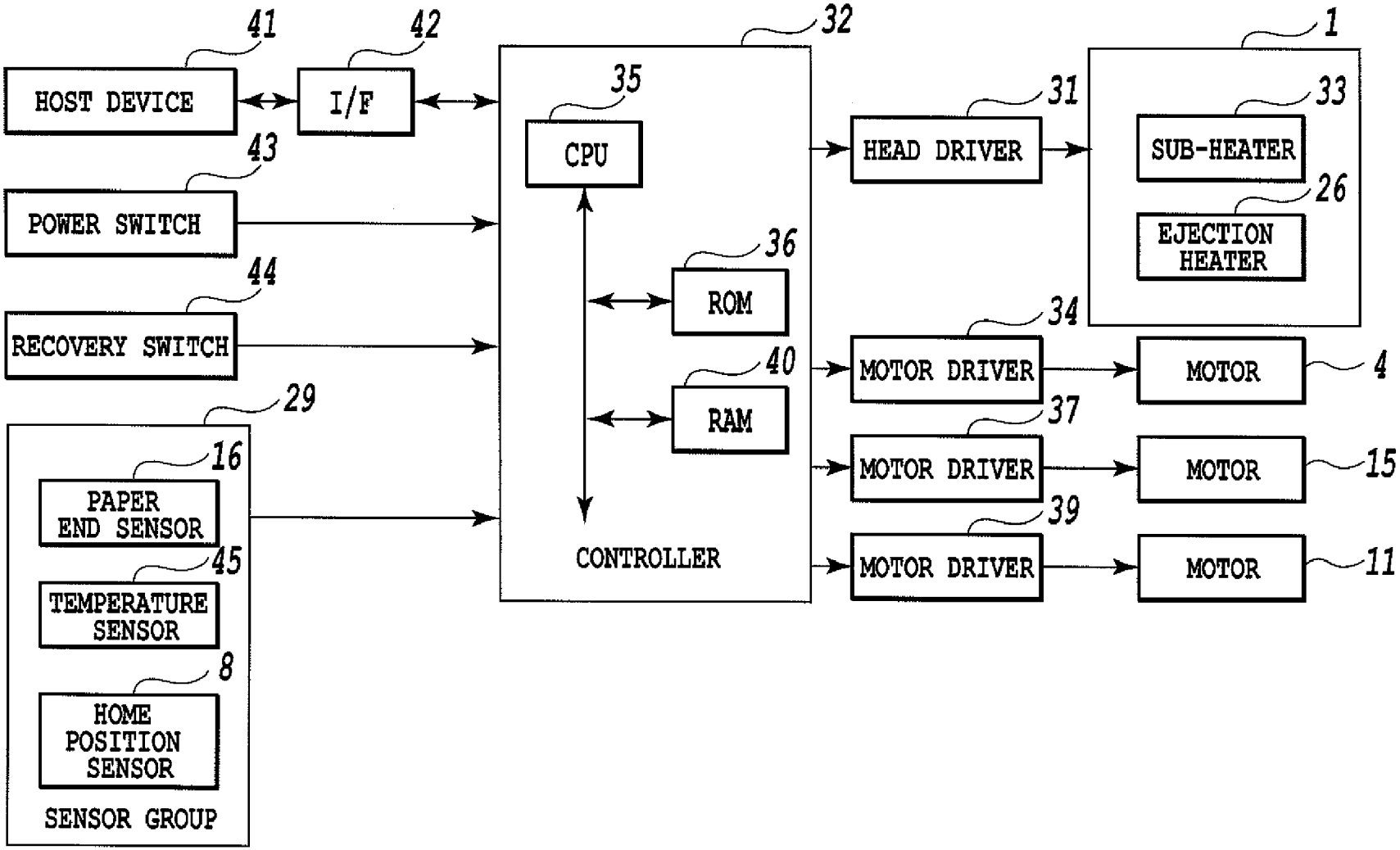
FIG. 9 is a block diagram showing a control configuration of an ink jet printing apparatus applied in the embodiments of this invention.

FIG. 9 is a block diagram showing a control configuration of the ink jet printing apparatus applied in this embodiment. In the figure, a controller 32 is a main control unit that has, for example, a CPU 35 in the form of a microcomputer, a ROM 36 storing programs, necessary tables and other fixed data, and a RAM 40 provided with an area for developing image data and a work area. A host device 41 is an image data source (which may be a computer that generates and processes data of images to be printed or an image reader for scanning an image). Image data, commands and status signals are transferred between the host device 41 and the controller 32 via an interface (I/F) 42.

A power switch 43 and a recovery switch 44 for initiating a suction-based recovery operation are switches to accept commands from an operator. A sensor group 29 detects a status of the apparatus and includes the above-described home position sensor 8, paper end sensor 16 and also a temperature sensor 45 for detecting ambient temperatures.

A head driver 31 drives electrothermal conversion elements (ejection heaters) in the print head cartridge 1 according to print data. The head driver 31 includes a shift register to align print data, a latch circuit to latch data at an appropriate timing, logic circuit elements to activate the ejection heaters 26 in synchronism with drive timing signals, and a timing setting unit to set an appropriate drive timing.

The print head cartridge 1 has a sub-heater 33. The sub-heater 33 adjusts the temperature of the cartridge to stabilize ink ejection characteristics. It may be formed on the printing element board along with the ejection heaters 26 or attached to the print head cartridge 1.

A motor driver 34 drives the carriage motor 4; a motor driver 37 drives the LF motor 15; and a motor driver 39 drives the feed motor 11.

Figure 16:
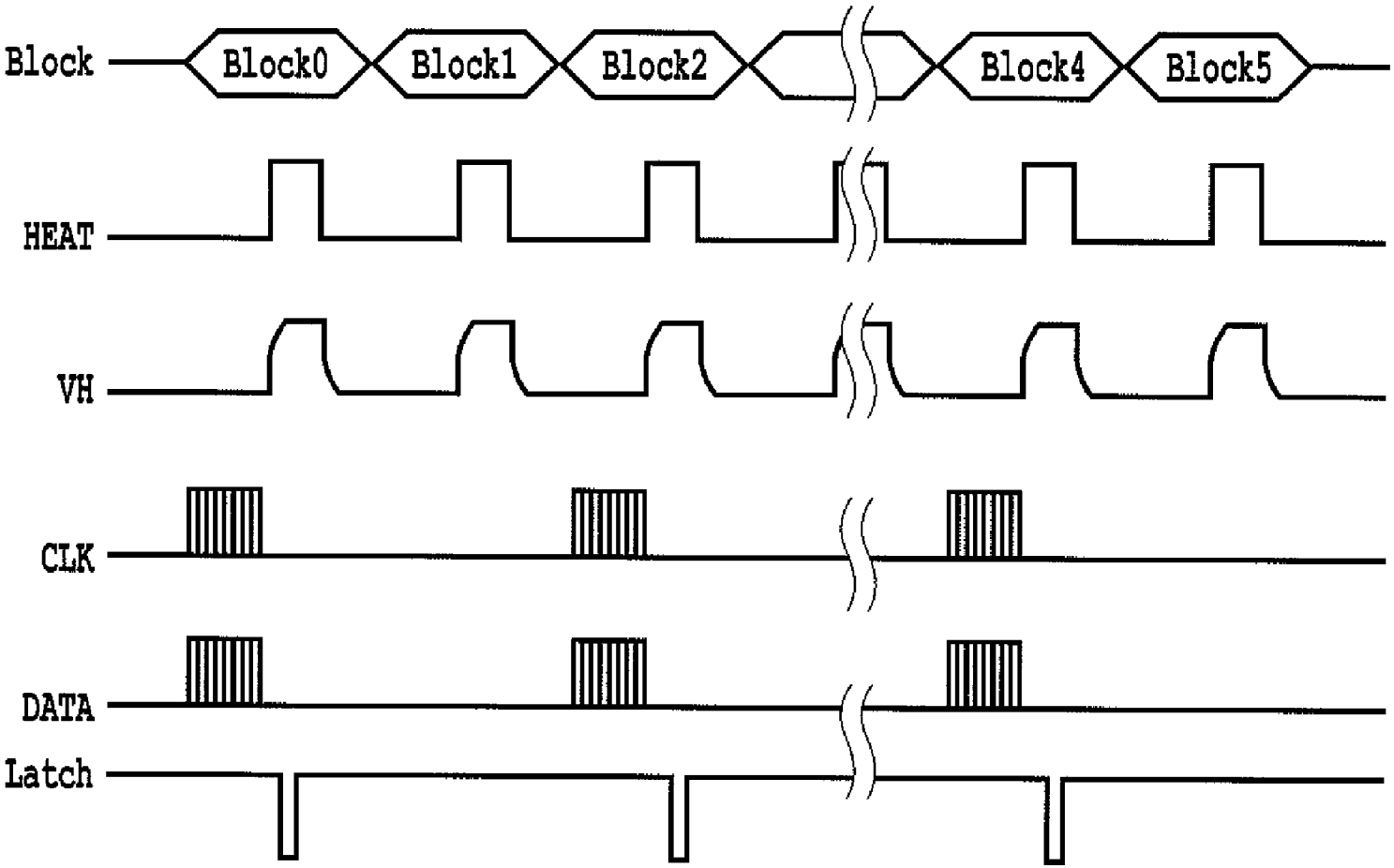
FIG. 16 is a timing chart showing a variety of signals applied to heaters for drive control.

FIG. 16 is a timing chart showing a variety of signals for controlling the energization of individual heaters in this embodiment. A latch that temporarily holds print data takes in, according to a transfer clock (CLK) supplied from an input terminal, serially supplied print data (DATA) and block data (Block) for time-division driving and then outputs the print data parallelly. A plurality of heaters in one and the same nozzle column are divided into two or more groups for separate activation, with the heaters of the same group driven at the same timing. The drive timing of each group is determined by a selection circuit having a block enable supplied from an input terminal select an appropriate Block signal.

Each of the drivers corresponding to the associated groups is supplied a result of logical AND between a periodically applied heat pulse (HEAT) and an output value from the selection circuit. If the output signal of logical AND is high, the corresponding driver turns on, causing a current (VH current) to flow to the connected heaters.

Next, the characteristic facts of this invention will be explained along with the result of verification experiments conducted by the inventor of this invention. First, six color inks used in this embodiment will be explained. In addition to the basic four colors—cyan, magenta, yellow and black, this embodiment also uses light cyan and light magenta. The light cyan and light magenta use the same pigments as cyan and magenta inks, respectively, but with about one-sixth the colorant densities. Measurements of viscosities of six color inks have found that cyan, magenta and yellow inks have about 3.5 mPa·s, black ink 2.5 mPa·s and light cyan and light magenta about 2.0 mPa·s.

Figure 1:
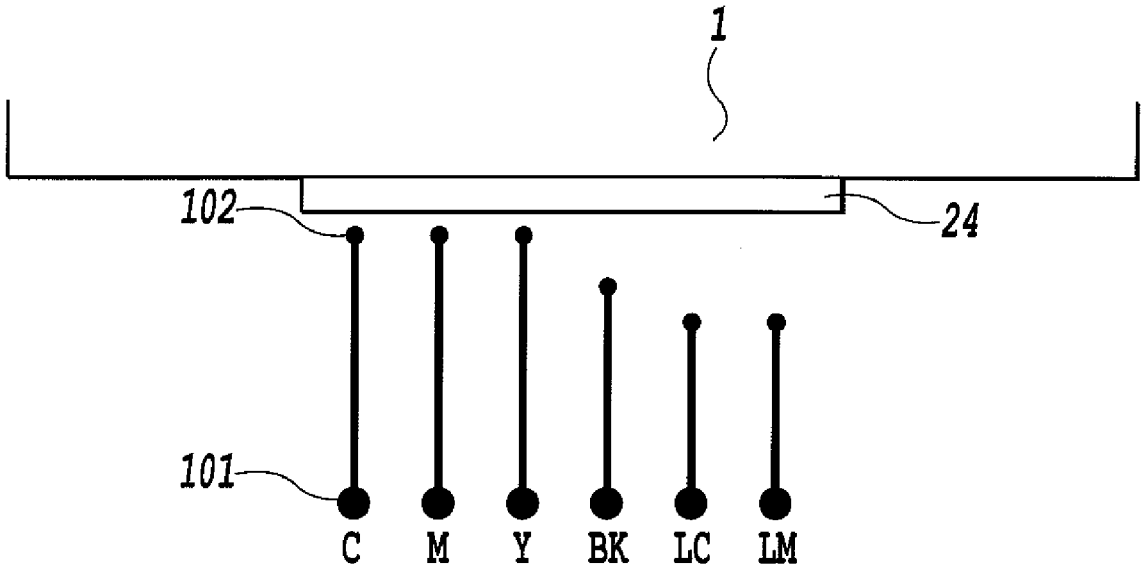
FIG. 1 shows how ink ejection is influenced by differences in physical property.

FIG. 1 shows ejection states of individual nozzle columns, as seen from a side surface of the print head cartridge 1, when voltage pulses such as shown in FIG. 8 are applied under the same condition (in the same waveform) to the heaters 26 for each color arrayed in the printing element board 24. The condition in this experiment is as follows: the drive voltage VH was fixed at 24 V, the preheat pulse width P1 at 0.30 μs, the main heat pulse width P3 at 0.52 μs and the interval P2 at 0.40 μs. Under this condition, the ejection volume for each color was about 3 pl.

In the figure six liquid columns are shown. They are, from left to right, cyan, magenta, yellow, black, light cyan and light magenta, with their liquid columns differing in length among different colors. The inventor of this invention measured ejection speeds of main drop and satellite for each color. It is found that the main drops 101 have ejection speeds of approximately 16.0 m/s for all colors, whereas the satellites 102 have varying ejection speeds among ink colors, about 8.5 m/s for cyan, magenta and yellow, about 11.3 m/s for black and about 12.5 m/s for light cyan and light magenta. The variations in the satellite ejection speed cause the distance from the main drop 101 to the trailing satellite 102 (liquid column length) to vary from one ink color to another. Since there is a speed difference between the main drop and its satellite, the liquid column continues to extend until the main drop lands on the print medium. The inventor of this invention measured the liquid column length for each color at a predetermined timing. The measurement shows that the columns of cyan, magenta and yellow inks were approximately 420 μm long, black about 350 μm long and light cyan and light magenta about 310 μm in length. Based on these close observations, the inventor of this invention has found that the differences in ejection characteristics among different inks are largely attributable to differences in physical properties among the inks, especially viscosity differences.

Figure 10:
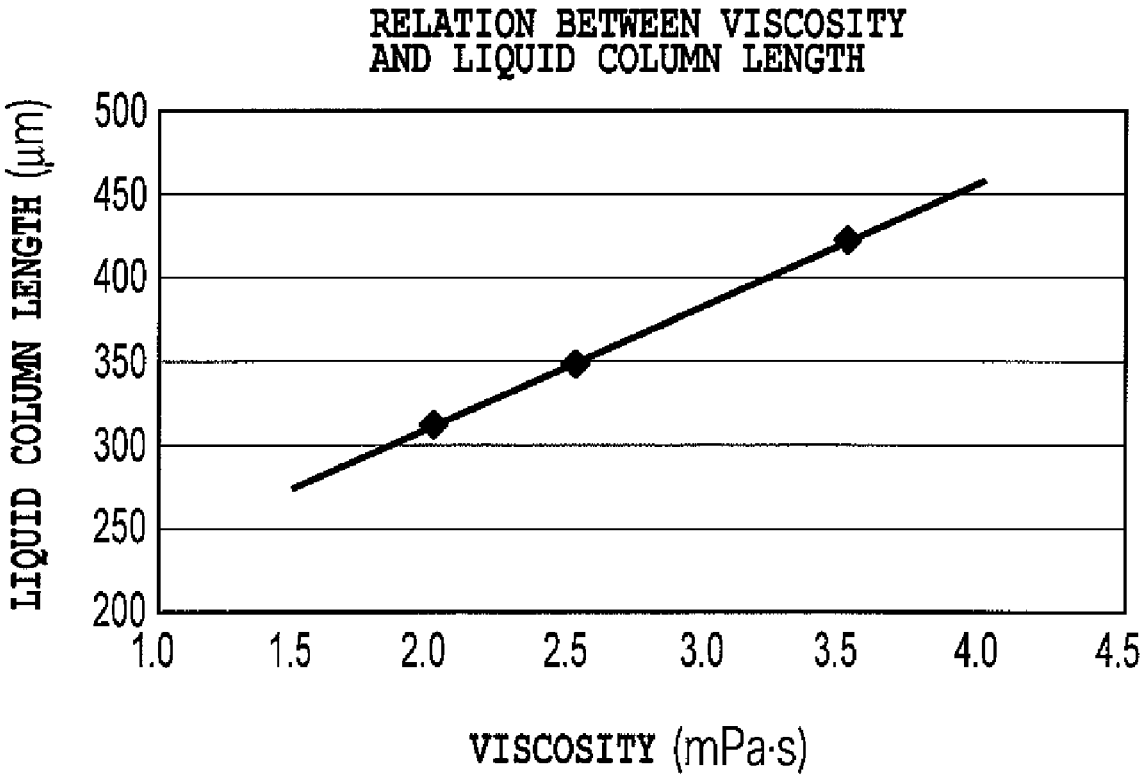
FIG. 10 is a graph showing a relation between an ink viscosity and a liquid column length.

FIG. 10 is a graph showing a relation between an ink viscosity and a liquid column length, obtained in the experiment conducted by the inventor of this invention.

Figure 11:
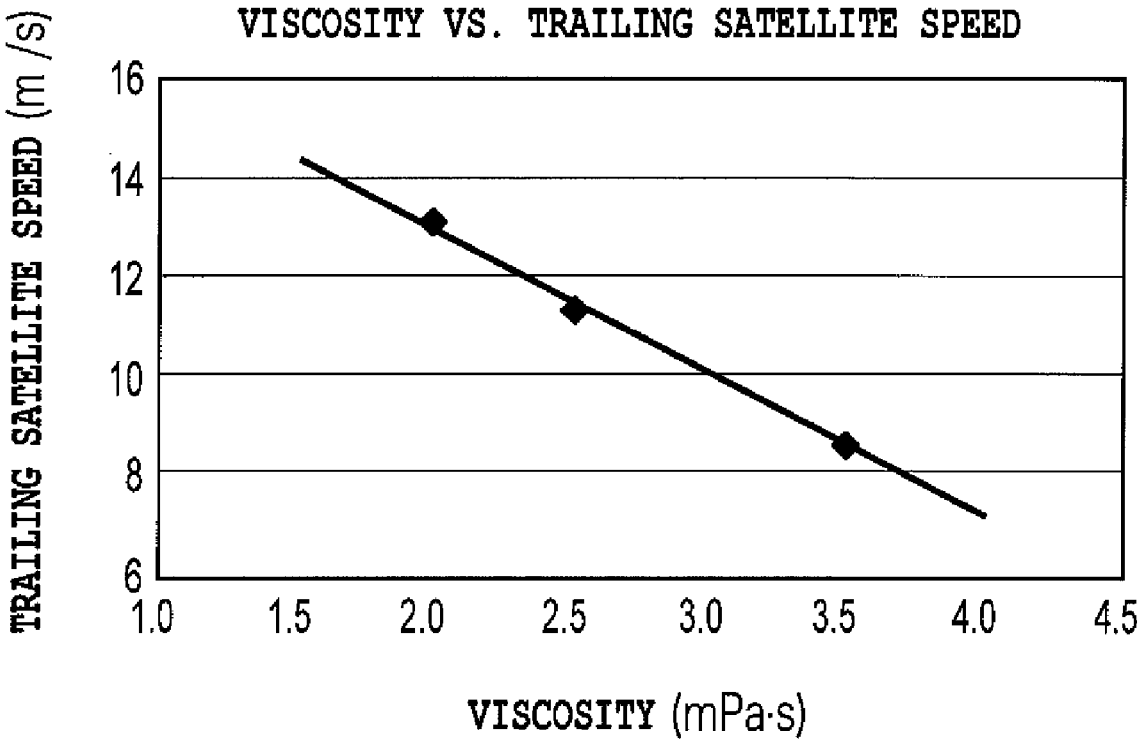
FIG. 11 is a graph showing a relation between an ink viscosity and an ejection speed of a satellite flying at a trailing end of a liquid column when ejection operations are executed under the same conditions.

FIG. 11 is a graph showing a relation between an ink viscosity and an ejection speed of a trailing satellite (which is flying at the rear end of a liquid column) when the ejection operation is performed under the same condition as that of FIG. 10. These graphs indicate that the ink viscosity has a correlation with the liquid column length or the ejection speed of a trailing satellite. As the ink viscosity increases, the liquid column length increases and the speed of a trailing satellite decreases.

Ink droplets having different liquid column lengths therefore form different shapes of dots on a print medium after landing.

Figure 12C:
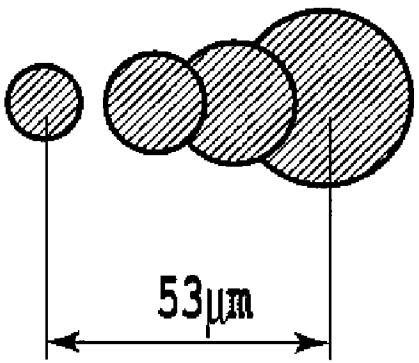
FIGS. 12A-12C illustrate shapes of dots formed on a print medium by ink droplets having different liquid column lengths.
Figure 12B:
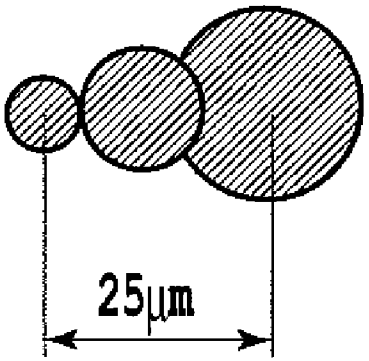
Figure 12A:
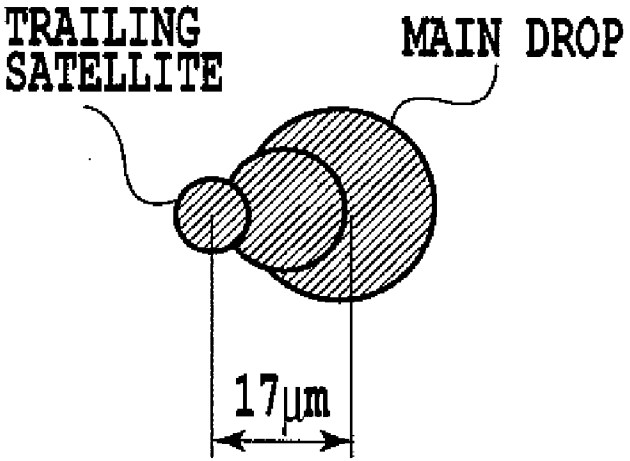

FIGS. 12A-12C show shapes of dots that ink droplets with different liquid column lengths form on a print medium. Dots shown here for different ink colors are formed under the following conditions in addition to the above drive conditions: an ejection frequency is set at 30 kHz, a carriage speed at 25 inches/sec and a distance from the ejection face to a print medium (head-medium distance) at 1.5 mm. In this experiment, a print medium of Canon make, HR-101, was used. With these drive conditions and carriage speed, a resolution of 1,200 dpi can be realized in the main scan direction.

When ink ejection is executed as the carriage is moved in the main scan direction, an ink droplet has two speed components: one perpendicular to a print medium and one representing a carriage scanning speed. So, a difference in landing timing on the print medium translates into a print position deviation in the main scan direction. That is, the larger the landing timing difference between the main drop and its satellite, the farther apart they land in the main scan direction.

FIG. 12A shows a landing state of light cyan and light magenta ink droplets with a viscosity of 2.0 mPa·s. Measurements made by the inventor of this invention have shown that the distance between a main dot and its trailing satellite dot was about 17 μm and the landing dot area formed of these dots about 405 $\mu m^2$. FIG. 12B shows a landing state of black ink droplets with a viscosity of 2.5 mPa·s. The distance between a main dot and its trailing satellite dot was about 25 μm and the landing dot area about 446 $\mu m^2$. Further, FIG. 12C shows a landing state of cyan, magenta and yellow ink droplets with a viscosity of 3.5 mPa·s. The distance between a main dot and its trailing satellite dot was about 53 μm and the landing dot area about 504 $\mu m^2$. In this example, since the printing resolution is 1,200 dpi, the width of one pixel area is about 21 μm. If ink droplets land in the states shown in FIG. 12B and FIG. 12C, printed dots each occupy two or more pixels, which is not desirable from the standpoint of image design. Furthermore, such variations, if they exist among different ink colors, will affect image density and tonality expressed on a print medium, resulting in an image output with poor color reproducibility.

Figure 13:
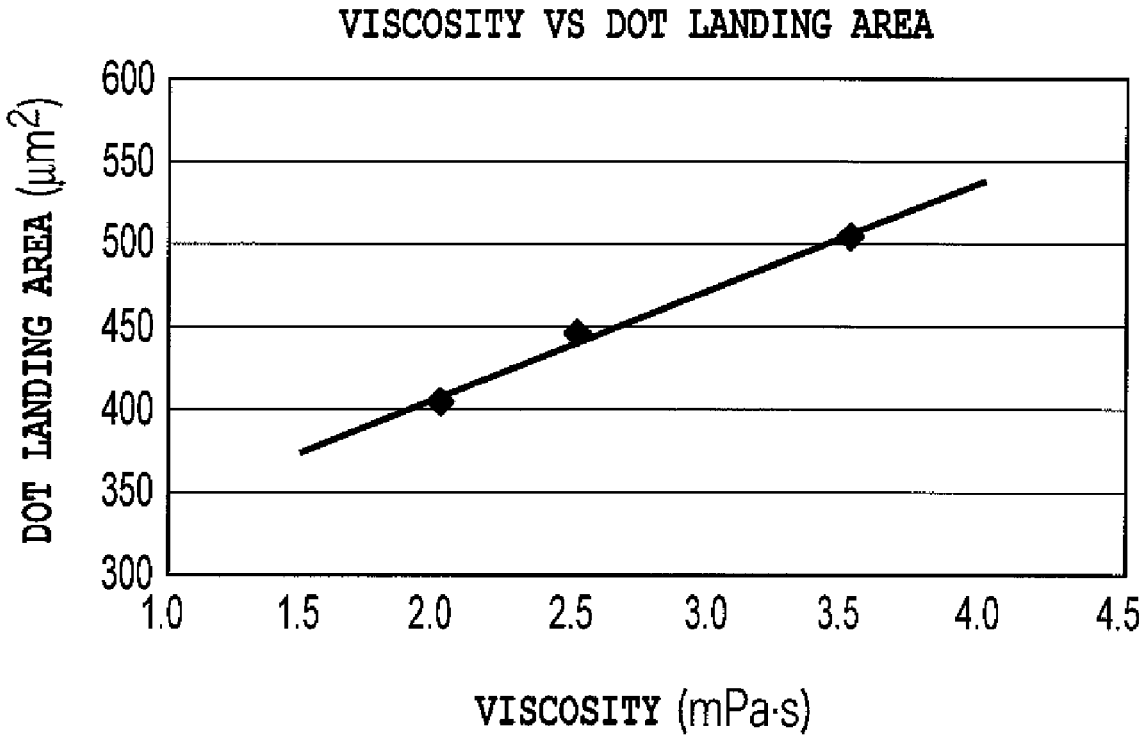
FIG. 13 is a graph showing a relation between an ink viscosity and an area of a landing dot.

FIG. 13 is a graph based on the above result, showing a relation between an ink viscosity and a dot landing area. It is seen that as the ink viscosity increases, the dot landing area also increases.

The above result has led us to conclude that, if the ejection speed differences between a main drop and its satellite can be made nearly equal among different ink colors, it must be possible, even if the inks used have different viscosities, to make the liquid column lengths, dot landing areas and even image densities and tonalities equal among the different colors. After close examinations, the inventor of this invention has succeeded in keeping the main-drop-and-satellite ejection speed differences among different ink colors within a predetermined range, by appropriately adjusting the drive pulse for each ink color to control the ejection speed of the main drop.

Figure 14:
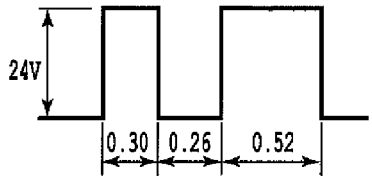
FIG. 14 is a table showing drive pulse waveforms by ink colors, as applied in a first embodiment of this invention.
Figure 14:
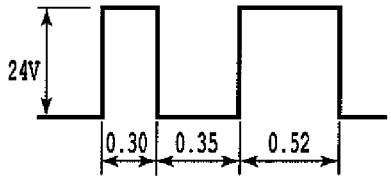
Figure 14:
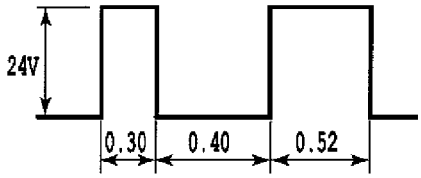

FIG. 14 is a table showing drive pulse waveforms applied for each ink color in this embodiment. In this embodiment, the same drive conditions that were used previously are commonly set for all ink colors, i.e., the drive voltage VH is set at 24 V, the preheat pulse width P1 at 0.30 μs and the main heat pulse width P3 at 0.52 μs. The interval P2, however, is set at a different value for a different color. More specifically, the intervals for cyan, magenta and yellow are changed to 0.26 μs and black to 0.35 μm, with those for light cyan and light magenta remaining at 0.40 μs.

Under these settings the ejection operation was executed and measurements were made of ejection speeds of main drop and satellite for each ink color. Cyan, magenta and yellow inks were found to have a main drop ejection speed of about 12 m/s and a trailing satellite speed of about 8.5 m/s. For black ink, the main drop ejection speed was about 15 m/s and the trailing satellite speed about 11.3 m/s. For light cyan and light magenta, the main drop ejection speed was about 16 m/s and the trailing satellite speed about 12.5 m/s. This shows that there is no change in the trailing satellite ejection speed for any ink color but that the main drop ejection speed has decreased for cyan, magenta, yellow and black inks, resulting in a smaller speed difference between the main drop and its trailing satellite. As a result, the main-drop-and-satellite speed difference is about 3.5 m/s for cyan, magenta and yellow and 3.7 m/s for black. These speed differences are approximately equal to about 3.5 m/s, the speed difference for light cyan and light magenta inks.

Figure 15:
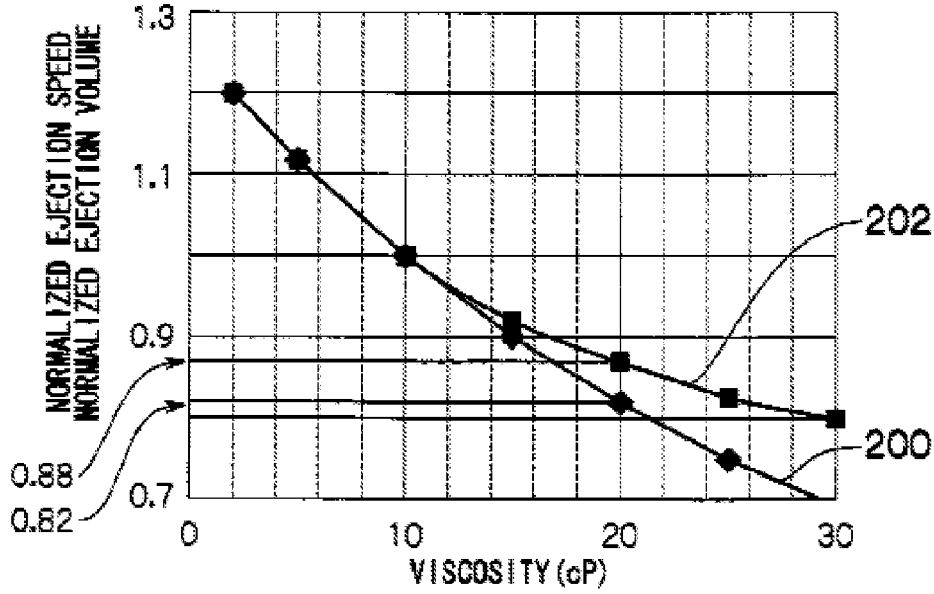
FIG. 15 shows ejection states of individual nozzle columns, as seen from a side surface of the print head cartridge 1, when the ejections are executed under the condition of the first embodiment.

FIG. 15 shows ejection states of individual nozzle columns, as seen from a side surface of the print head cartridge 1, when the ink ejection operation is executed under the condition of FIG. 14. Although the positions of main drops vary among the different inks as they have different main drop ejection speeds, it is seen that the distances between the main drop and its trailing satellite, i.e., the lengths of liquid columns, are equal. This has contributed to making the landing dot areas of individual ink colors almost constant at about 405 μm2, which in turn minimizes variations in image density and tonality expressed on a print medium, realizing an image output with excellent color reproducibility.

Examinations on the part of the inventor of this invention have found that, if variations in the area of dots formed on a print medium are within ±10% of an average for all colors, image impairments are not easily recognized. If drive pulses for each color are modulated to have the area of dots formed on a print medium fall within this range, though it varies according to the kind of print medium, the object of the present invention can be realized.

Second Embodiment

A second embodiment of this invention will be described as follows. In this embodiment, too, the same printing apparatus, print head cartridge and six color inks with the same compositions as those of the first embodiment will be used.

Figure 17:
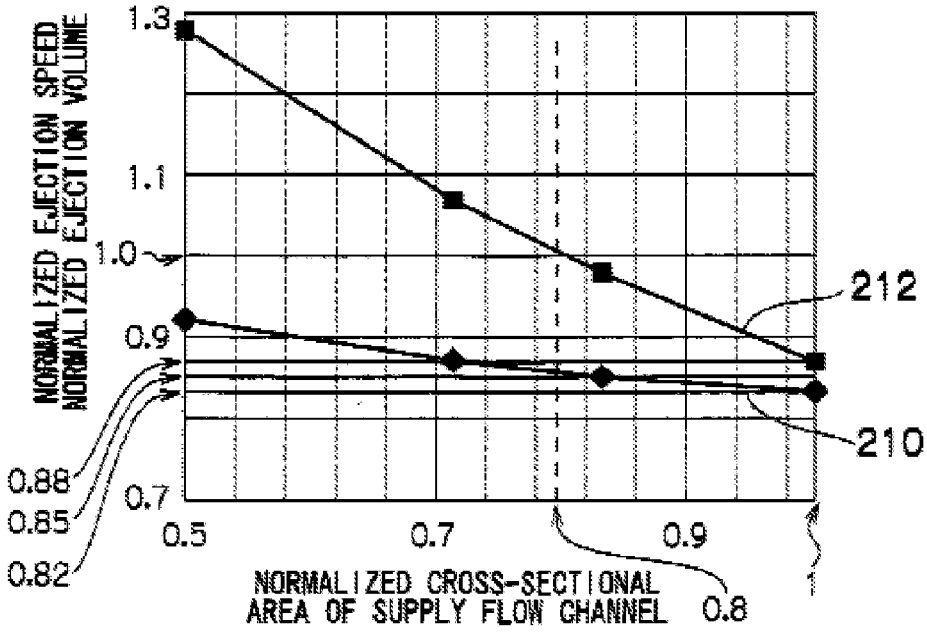
FIG. 17 is a table showing drive pulse waveforms by ink colors, as applied in a second embodiment of this invention.

FIG. 17 is a table showing drive pulse waveforms by ink colors, as applied in this embodiment. In this embodiment, the preheat pulse width P1 is commonly set at 0.30 μs for all colors, but the drive voltage VH, main heat pulse width P3 and interval P2 are set at different values for different colors. More specifically, for cyan, magenta and yellow, the drive voltage VH is set at 20 V, the main heat pulse width P3 at 0.64 μs and the interval P2 at 0.32 μs. For black, the drive voltage VH is set at 22.8 V, the main heat pulse width P3 at 0.58 μs and the interval P2 at 0.38 μs. For light cyan and light magenta, the drive voltage VH is set at 24 V, the main heat pulse width P3 at 0.52 μs and the interval P2 at 0.40 μs.

Under these settings the ejection operation was performed and measurements were taken of ejection speeds of main drop and satellite for each ink color. The result of measurements is as follows. For cyan, magenta and yellow ink, the main drop ejection speed was about 12 m/s and the trailing satellite speed about 8.5 m/s. For black ink, the main drop ejection speed was about 15 m/s and the trailing satellite speed about 11.3 m/s. For light cyan and light magenta, the main drop ejection speed was about 16 m/s and the trailing satellite speed about 12.5 m/s. Although there are no changes in the trailing satellite speed for any ink color, the main drop ejection speeds for cyan, magenta, yellow and black have decreased, thus reducing the speed differences with respect to the satellites. As a result, the main-drop-and-satellite speed difference is about 3.5 m/s for cyan, magenta and yellow and 3.7 m/s for black. These speed differences are approximately equal to about 3.5 m/s, the speed difference for light cyan and light magenta inks.

As a result, as in the first embodiment, the area of landing dots can be made almost constant at about 405 $\mu m^2$ for all colors, which in turn minimizes variations in image density and tonality expressed on a print medium, realizing an image output with excellent color reproducibility.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-275305, filed Oct. 6, 2006, which is hereby incorporated by reference herein in its entirety.

What is claimed is:

1. An ink jet printing method for forming an image by using a print head, wherein the print head has a plurality of printing elements for a plurality of inks with different viscosities, wherein the printing elements eject ink when applied a voltage pulse, the ink jet printing method comprising the step of:

adjusting a waveform of the voltage pulse, for each of the plurality of inks, in a way that reduces an ejection speed of ink as the viscosity of ink increases.

* * * * *